United States Patent [19]

Russell et al.

[11] 4,133,176

[45] Jan. 9, 1979

[54] APPARATUS AND METHOD FOR HYDRAULIC MAKEUP AND CONTROL

[75] Inventors: Duane K. Russell, Everett; James L. Cordell, Snohomish, both of Wash.

[73] Assignee: Western Gear Corporation, Everett, Wash.

[21] Appl. No.: 797,905

[22] Filed: May 18, 1977

[51] Int. Cl.[2] ..... F16D 31/00

[52] U.S. Cl. ..... 60/327; 60/464; 91/390

[58] Field of Search ..... 60/327, 455, 464; 91/390; 175/52; 254/29 R

[56] References Cited

U.S. PATENT DOCUMENTS

| | | | |
|---|---|---|---|
| 2,961,829 | 11/1960 | Weisenbach | 60/464 |
| 3,636,708 | 1/1972 | Karman et al. | 60/464 X |
| 3,949,818 | 4/1976 | Russell | 175/52 |

*Primary Examiner*—Edgar W. Geoghegan
*Attorney, Agent, or Firm*—Seed, Berry, Vernon & Baynham

[57] ABSTRACT

An adjustable hydraulic makeup and control system is provided for supplementing the primary hydraulic flow to overcome leakage and thus be able to maintain a constant pulling load on a drill pipe or other tool in a well hole for an indefinite length of time.

2 Claims, 1 Drawing Figure

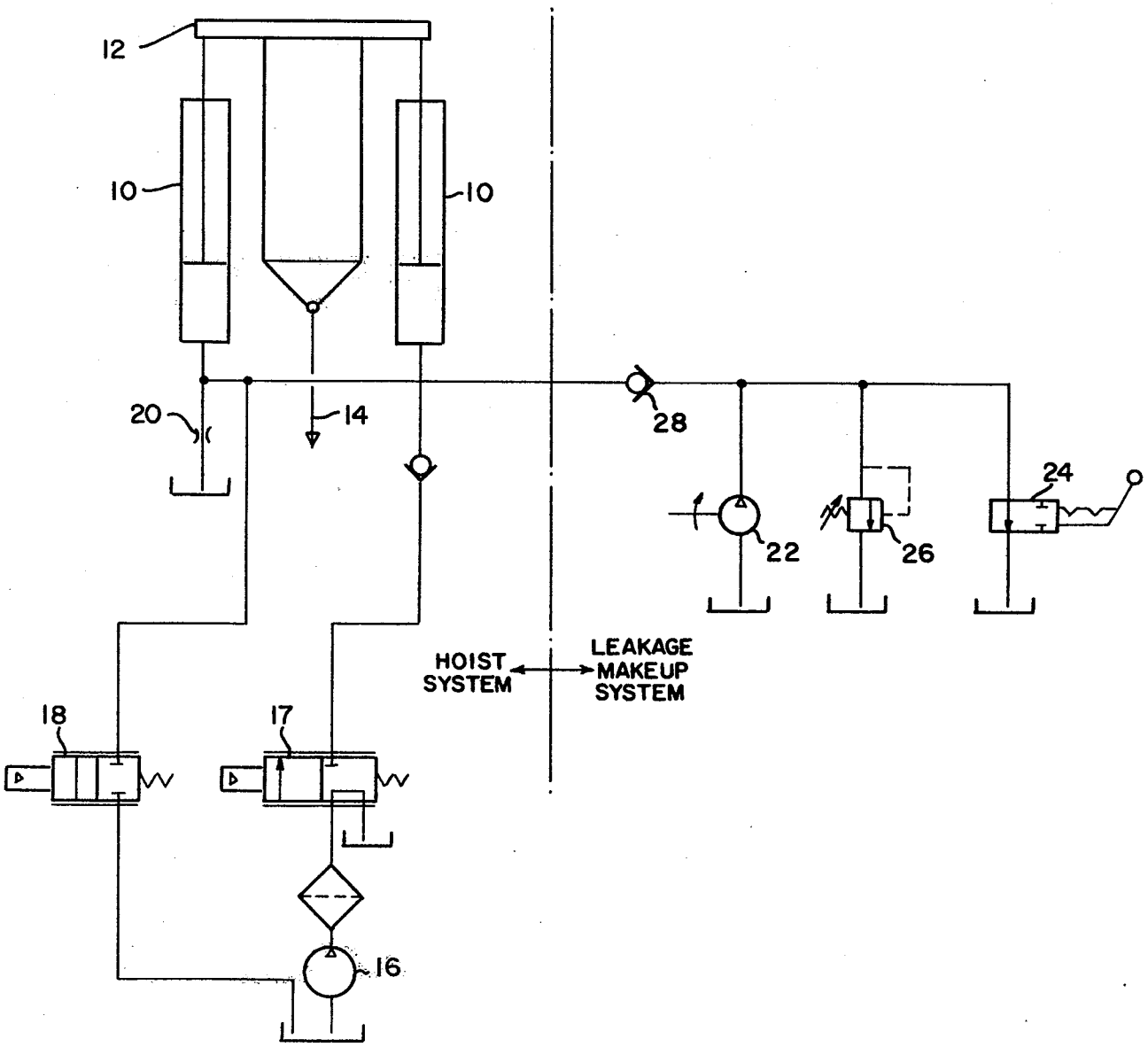
24
26
22
28
LEAKAGE MAKEUP SYSTEM
HOIST SYSTEM
10
14
12
10
20
17
16
18

APPARATUS AND METHOD FOR HYDRAULIC MAKEUP AND CONTROL

BACKGROUND OF THE INVENTION

1. Field of the Invention

This invention pertains to hydraulic drilling rigs and, more particularly, to hydraulic control systems for such drilling rigs.

2. Description of the Prior Art

Hydraulic drilling rigs have pronounced advantages over block and tackle drilling rigs. In the use of the hydraulic drilling rigs it is often necessary to maintain a constant upward pull on a drill pipe or tool within the well. In some instances this upward pull must be maintained to hold the pipe or tool stationary in the well. In other instances this constant pull must be maintained to provide a slight upward movement of the pipe or the tool in the well. While hydraulic drilling rigs enable these operations to be performed very easily, the primary hydraulic fluid flow is subject to considerable internal leakage which varies with the load of the pipe and temperature. This leakage causes the pipe to be unable to be held stationary or to be pulled upwardly at a uniform rate.

SUMMARY OF THE INVENTION

It is an object of this invention to provide a hydraulic control system which will make up internal leakage to allow an adjustable constant upward pulling force to be applied on a pipe or tool in a well.

It is another object of this invention to provide a method for maintaining a constant upward pulling force on a pipe or a tool in a well and for varying that pulling force to maintain the pipe or tool stationary or with slight upward movement for an indefinite length of time.

Basically these objects are obtained by providing in addition to the primary hydraulic control system a secondary makeup system comprising a pump or other pressurized fluid supply source and an adjustable control for introducing the secondary hydraulic fluid at a variable rate either to maintain a constant pull to hold the load stationary or an excessive constant pull to produce an upward movement of the load.

The apparatus and method advantageously give the operator infinitely variable control of the pulling force on the load for an indefinite length of time allowing very sophisticated operations to be performed within the well.

BRIEF DESCRIPTION OF THE FIGURE OF THE DRAWING

The drawing illustrates a preferred hydraulic system schematic embodying the principles of the invention.

DETAILED DESCRIPTION OF THE PREFERRED EMBODIMENT

U.S. Pat. No. 3,949,818 describes an hydraulic drilling and/or workover rig which has a pair of hoist cylinders 10 connected by a tension structure 12 to a hoist load 14 such as a drill pipe or well workover tool. The operation of such a hydraulic drilling rig is well known and the description in U.S. Pat. No. 3,949,818 is hereby incorporated herein by reference thereto. The hydraulic drilling rigs conventionally include a primary pump 16, a raise valve 17 and a lower valve 18. Various components of the conventional hydraulic control system, primarily in the valves, allow substantial leakage back to the reservoir. This leakage is illustrated schematically by the reference numeral 20 in the drawing. Since the rate of internal leakage varies with the load (pressure) and temperature, a fixed rate of makeup flow cannot be utilized.

The hydraulic makeup system of this invention utilizes an adjustable pressure source to provide for whatever makeup flow rate may be desired to compensate for the internal leakage or to supplement the pulling force to actually lift the load. If makeup fluid is supplied at a pressure equal to the hoist load induced pressure, the hoist will hold position without creepage. If makeup fluid is supplied at a pressure greater than the load induced pressure, a pulling force to move the pipe or tool upwardly can be applied and maintained.

The secondary hydraulic system for making up includes a pump 22 which returns directly to reservoir through selector valve 24 which is shown in the open (off) position. When the selector valve is moved to the left or closed (on) position, the flow from the pump 22 will either return to the reservoir through an adjustable relief valve 26 or will be forced into the primary hoist hydraulic system through a check valve 28 if the pressure setting of the relief valve is higher than the hoist load induced pressure. In practice, a portion of the flow passes through check valve 28, to make up leakage, and the balance of the secondary flow returns to the reservoir through relief valve 26.

Some friction is always present in the hoist which provides sufficient latitude in the pressure setting of the relief valve 26 to make use of this adjustable pressure source for eliminating the creepage. In use, the drilling rig operator adjusts the relief valve 26 setting as required to eliminate creepage. If the setting is too low, the hoist will creep downward. If the setting is too high, all flow from the makeup pump will be diverted into the primary hoist hydraulic system and the hoist will move upward. If a pulling force, in excess of the weight, is to be applied to the drilling rig the operator simply increases the relief valve 26 setting until the desired force has been obtained. Since the makeup pump has to supply only enough fluid to make up for leakage, plus a safety allowance, the capacity of the pump 22 may be kept small, thereby keeping energy losses to a minimum. The only additional energy losses, over those already present due to leakage, are those due to excess flow capacity of the makeup pump 22 passing through the relief valve 26.

While the preferred embodiment of the invention has been illustrated and described it should be understood that variations will be apparent to one skilled in the art without departing from the principles herein. Accordingly, the invention is not to be limited to the specific embodiment illustrated.

The embodiments of the invention in which a particular property or privilege is claimed are defined as follows:

1. The method of holding a constant pulling load on a drill pipe with an hydraulic driling rig, comprising;

connecting a set of hydraulic cylinders to the drill pipe, pumping a large capacity primary flow of an hydraulic fluid to the cylinders for positioning the pipe, halting the primary flow of fluid to positively hold the pipe, and pumping a smaller capacity makeup hydraulic fluid to the cylinders for replenishing primary fluid lost by leakage while the flow is halted whereby the pipe can be accurately held in a stationary position.

2. The method of claim 1 including the step of adjusting the small capacity fluid flow to a higher rate than is lost by leakage to maintain an upward active pulling force on the pipe.

* * * * *